US007357156B2

(12) United States Patent
Ueda et al.

(10) Patent No.: US 7,357,156 B2
(45) Date of Patent: Apr. 15, 2008

(54) INDUSTRIAL TWO-LAYER FABRIC

(75) Inventors: Ikuo Ueda, Shizuoka (JP); Masakazu Murakami, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 142 days.

(21) Appl. No.: 11/431,007

(22) Filed: May 10, 2006

(65) Prior Publication Data

US 2006/0260708 A1 Nov. 23, 2006

(30) Foreign Application Priority Data

May 19, 2005 (JP) ..... P2005-146809

(51) Int. Cl.
*D21F 7/08* (2006.01)
*D03D 25/00* (2006.01)

(52) U.S. Cl. ..... 139/383 A; 162/358.2; 162/902

(58) Field of Classification Search ..... 139/383 A; 162/358.2, 902; 442/203, 205
See application file for complete search history.

(56) References Cited

U.S. PATENT DOCUMENTS

| | | | | |
|---|---|---|---|---|
| 4,231,401 A | | 11/1980 | Matuska | |
| 4,934,414 A | * | 6/1990 | Borel | 139/383 A |
| 5,022,441 A | * | 6/1991 | Tate et al. | 139/383 A |
| 5,158,117 A | | 10/1992 | Huhtiniemi | |
| 5,343,896 A | * | 9/1994 | Schroder et al. | 139/383 A |
| 5,421,375 A | * | 6/1995 | Praetzel | 139/383 A |
| 5,437,315 A | * | 8/1995 | Ward | 139/383 A |
| 5,449,026 A | * | 9/1995 | Lee | 139/383 A |
| 5,454,405 A | * | 10/1995 | Hawes | 139/383 A |
| 5,482,567 A | * | 1/1996 | Barreto | 139/383 A |
| 5,544,678 A | * | 8/1996 | Barrett | 139/383 A |
| 5,713,397 A | * | 2/1998 | Quigley | 139/383 A |
| 6,179,013 B1 | * | 1/2001 | Gulya | 139/383 A |
| 6,207,598 B1 | * | 3/2001 | Lee et al. | 442/206 |
| 6,585,006 B1 | * | 7/2003 | Wilson et al. | 139/383 A |
| 6,860,969 B2 | * | 3/2005 | Troughton | 162/348 |
| 7,059,357 B2 | * | 6/2006 | Ward | 139/348 |
| 7,219,701 B2 | * | 5/2007 | Ward | 139/383 A |

FOREIGN PATENT DOCUMENTS

| | | |
|---|---|---|
| EP | 0053317 A1 | 6/1982 |
| EP | 1365066 A1 | 11/2003 |

OTHER PUBLICATIONS

European Search Report (Jul. 19, 2006).

* cited by examiner

*Primary Examiner*—Robert Muromoto
(74) *Attorney, Agent, or Firm*—Rader, Fishman & Grauer, PLLC

(57) ABSTRACT

An industrial two-layer fabric having eight upper side warps and eight lower warps are stacked vertically forming upper and lower layers which are bound by a warp binding yarn of these warps. In a repeating unit of the upper layer, one of the warps has repetition of a design in which it passes over one upper side weft, passes under four successive upper side wefts, passes over one upper side weft, and passes under two upper side wefts, and an upper side weft has a design in which it passes over three upper side warps and then passes under one upper side warp to form, on the upper side, a weft long crimp corresponding to three warps, whereby forming an industrial fabric excellent in running stability, surface property and wear resistance.

9 Claims, 10 Drawing Sheets

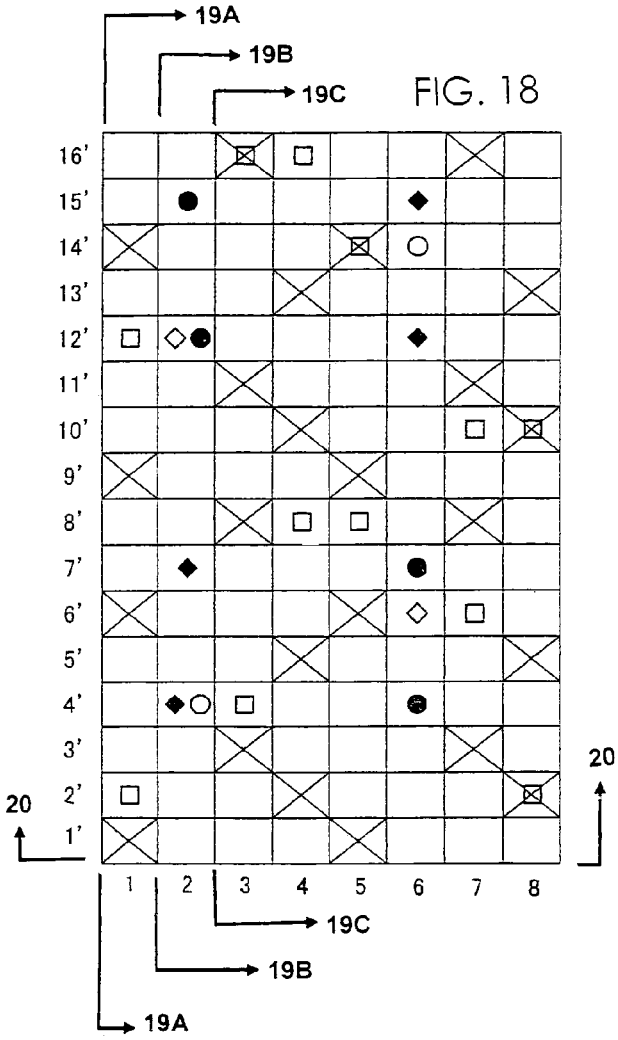
FIG. 18
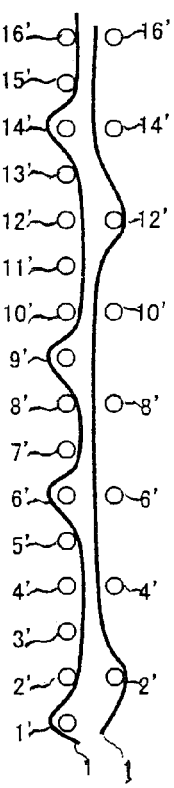
FIG. 19A
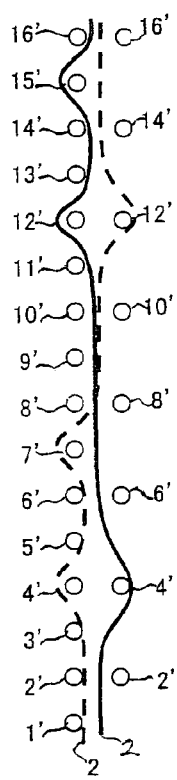
FIG. 19B
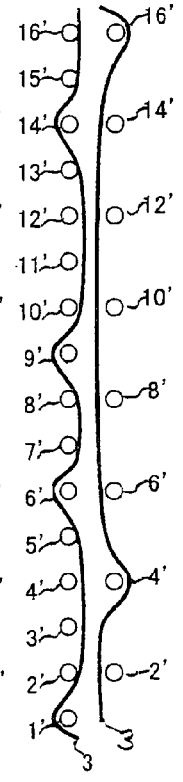
FIG. 19C
FIG. 20
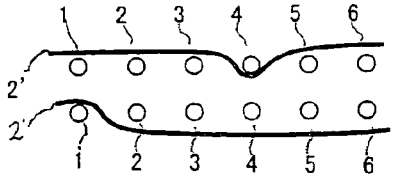

INDUSTRIAL TWO-LAYER FABRIC

TECHNICAL FIELD OF THE INVENTION

Fabrics woven with warps and wefts have conventionally been used widely as an industrial fabric. They are used in various fields including papermaking wires, conveyor belts and filter cloths and required to have fabric properties suited for the intended use or using environment. Of such fabrics, a papermaking wire used in a papermaking step for removing water from raw materials by making use of the meshes of a fabric must satisfy severe requirements. There is therefore a demand for the development of fabrics which do not transfer a wire mark of the fabric to paper and therefore have an excellent surface property, have enough rigidity and are therefore usable desirably even under severe environments, and are capable of maintaining conditions necessary for making good-quality paper for a long period of time. In addition, fiber supporting property, improvement in a papermaking yield, good water drainage property, wear resistance, dimensional stability and running stability are required. In recent years, owing to the speed-up of a papermaking machine, requirements for papermaking wires become severe further.

BACKGROUND ART

Since most of the requirements for the industrial fabric and how to satisfy them can be understood by describing a papermaking fabric on which the most strict requirements are imposed among industrial fabrics, the present invention will hereinafter be described using the papermaking fabric as a representative example.

In a paper making machine, an increase in paper making speed inevitably raises dehydration speed so that dehydration power must be reinforced. Examples of the fabric with good dehydration property include two-layer fabrics having a dehydration hole penetrating from the upper side to the lower side of the fabric. Particularly, a two-layer fabric using a warp binding yarn which is woven with an upper side weft and a lower side weft to constitute an upper side surface design and a lower side surface design is developed with a view to satisfying the surface property, fiber supporting property and dehydration property which a papermaking fabric is required to have.

A two-layer fabric using a warp binding yarn is described in Japanese Patent Laid-Open No. 2004-36052. In the fabric disclosed therein, some warps function as a binding yarn to weave therewith an upper side layer and a lower side layer. At the same time, two warp binding yarns forming a pair constitute a portion of an upper side surface design and a portion of a lower side surface, while complementing each other so that the resulting fabric has excellent surface property and binding strength. According to the design diagram shown in Examples 1 to 3 of Japanese Patent Laid-Open No. 2004-36052, however, since twilled weave in which knuckles formed by the intersection of an upper side warp over an upper side weft regularly and continuously occur in a diagonal direction is adopted, marks in the diagonal direction stand out, which tends to cause wire marks on paper in a diagonal direction. Twilled weave has another problem that twill lines occur continuously in one direction so that a wire is stretched inevitably in the direction of the twill lines when it is used, and the deformation of the wire and meandering attributable thereto occur, resulting in deterioration in the running stability.

With regards to the design of the invention in which a upper side weft pass over three upper side warps and then passes under an upper side warp to form a weft long crimp corresponding to three warps on an upper side, only a ⅓ design in which an upper side warp passes over an upper side weft and then passes under three upper side wefts is described irrespective of twill weave or broken twill weave on pages 15 and 36 in a non-patent document "Seni Kogaku II: Orimono" written by Tatsuo Adachi, published by Jikkyo Shuppan.

DISCLOSURE OF THE INVENTION

With the foregoing problems in view, the present invention has been made. An object of the present invention is to provide, in an industrial two-layer fabric using, for binding, a ground yarn instead of an independent binding yarn, an industrial fabric which does not generate marks in a diagonal direction and at the same time, is excellent in rigidity in a diagonal direction, running stability, surface property, fiber supporting property and wear resistance.

The present invention relates to an industrial two-layer fabric which comprises eight pairs of warps obtained by vertically stacking eight upper side warps and eight lower side warps, and a plurality of upper side wefts and lower side wefts, wherein at least one of the eight upper side warps and eight lower side warps works as a warp binding yarn for binding an upper side layer and a lower side layer. In the upper side layer of the fabric, an upper side warp has repetition of a design in which the warp passes over an upper side weft, passes under four successive upper side wefts, passes over an upper side weft, and passes under two upper side wefts. An upper side weft has a design in which the upper side weft passes over three upper side warps and then passes under an upper side warp to form a weft long crimp corresponding to three warps on the upper side.

An upper side warp and a lower side warp of at least one of the eight pairs of upper side warps and lower side warps stacked vertically may be both warp binding yarns which are woven with an upper side weft and a lower side weft to constitute a portion of an upper side surface design and a portion of a lower side surface design. In this case, the warp binding yarns forming a pair may be woven with respective upper side wefts and cooperatively function as one warp to constitute an upper side complete design on an upper side surface, while the warp binding yarns forming a pair function as one warp to constitute a lower side surface design also on the lower side surface.

Alternatively, only an upper side warp of at least one of the eight pairs of the upper side warps and the lower side warps stacked vertically may be a warp binding yarn which is woven with an upper side weft and a lower side weft to constitute a portion of an upper side surface design and a portion of a lower side surface design. In this case, in the pair of the warp binding yarn and a lower side warp, the warp binding yarn (the upper side warp) may be woven with an upper side weft to function as one warp constituting an upper side complete design on an upper side surface, while on the lower side surface, the warp binding yarn and the lower side warp cooperatively function as warps constituting a lower side surface design.

Further alternatively, only a lower side warp of at least one of the eight pairs of upper side warps and lower side warps stacked vertically may be a warp binding yarn which is woven with an upper side weft and a lower side weft to constitute a portion of an upper side surface design and a portion of a lower side surface design. In this case, in the pair of a warp binding yarn and an upper side warp, the warp binding yarn (the lower side warp) and the upper side warp are woven with respective upper side wefts and cooperatively function as warps constituting an upper side complete design on an upper side surface, while the warp binding yarn function as one warp constituting a lower side surface design on the lower side surface.

In the case where both an upper side warp and a lower side warp of at least one of the eight pairs of upper side warps and lower side warps stacked vertically function as the warp binding yarns, one of the warp binding yarns may be woven with at least one upper side weft to form an upper side surface design, under which the other warp binding yarn may be woven with a lower side weft, while the one of warp binding yarns is woven with a lower side weft, over which the other warp binding yarn is woven with at least one upper side weft to constitute the upper side surface design, whereby the warp binding yarns forming a pair complement each other to form the upper side surface design and lower side surface design.

The upper side surface design may be a broken twill weave. Alternatively, the upper side surface design may be a twill weave. The number of the upper side wefts may be 1 to 2 times the number of the lower side wefts. The upper side warp and the lower side warp may be equal in diameter.

The present invention provides, in an industrial two-layer fabric using, for binding, a ground yarn instead of an independent binding yarn, an industrial fabric which does not generate marks in a diagonal direction and at the same time, is excellent in rigidity in a diagonal direction, running stability, surface property, fiber supporting property and wear resistance.

BRIEF DESCRIPTION OF THE DRAWINGS

FIG. 18 is a design diagram illustrating a repeating unit of the complete design of Example 6 of the present invention.

FIGS. 19A, 19B and 19C are cross-sectional views taken along the lines 19A-19A, 19B-19B and 19C-19C at warps 1, 2 and 3 of FIG. 18 respectively.

FIG. 20 is a cross-sectional view taken along the line 20-20 at weft 2' of FIG. 18.

Figure 1:
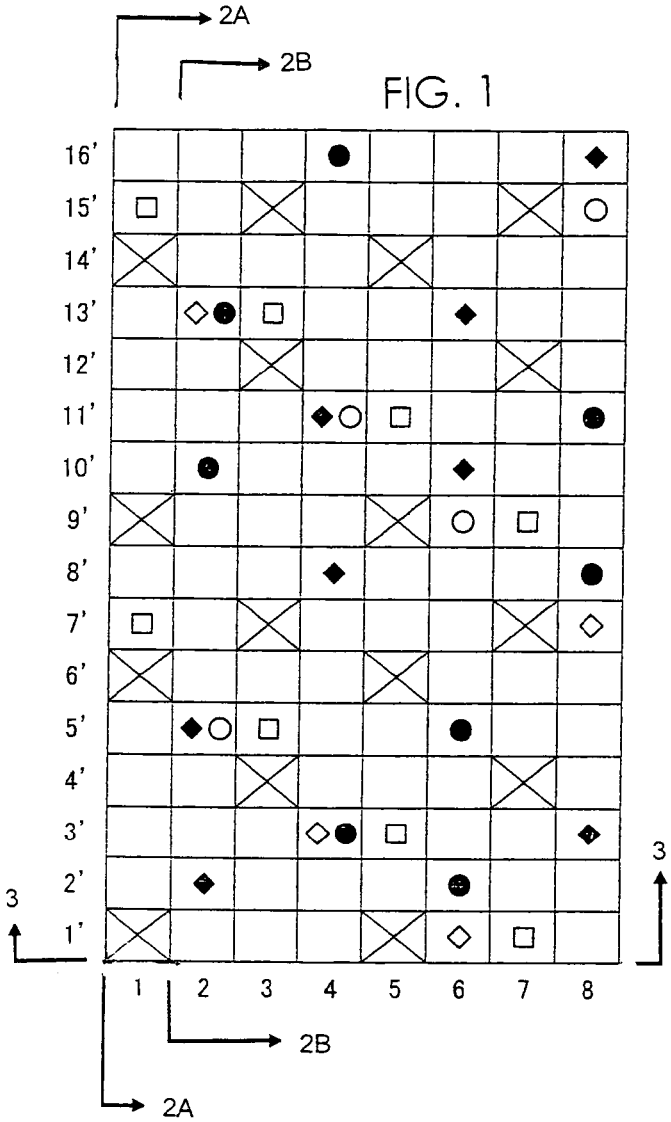
FIG. 1 is a design diagram illustrating a repeating unit of the complete design of Example 1 of the present invention.

In the drawings, numerals 1, 2, . . . 8 denote pairs of upper side warps and lower side warps, as well as pairs of warp binding yarns, pairs of upper side warps and warp binding yarns, or pairs of lower side warps and warp binding yarns. Numerals 1', 2' . . . 16' denote upper side wefts and lower side wefts.

DETAILED DESCRIPTION OF THE INVENTION

The present invention provides an industrial two-layer fabric which comprises eight pairs of warps obtained by vertically stacking eight upper side warps and eight lower side warps, and a plurality of upper side wefts and lower side wefts, and has at least one of the eight upper side warps and eight lower side warps as a warp binding yarn for binding an upper side layer and a lower side layer, characterized in that in the upper side layer of the fabric, a warp has repetition of a design in which it passes over an upper side weft, passes under four successive upper side wefts, passes over an upper side weft and passes under two upper side wefts and an upper side weft has a design in which it passes over three upper side warps and then passes under an upper side warp to form a weft long crimp corresponding to three warps on the upper side. For the upper side layer thus woven, either twill weave or broken twill weave can be employed. The fabric of the present invention composed of eight pairs of warps obtained by vertically stacking eight upper side warps and eight lower side warps and a plurality of upper side wefts and lower side wefts is industrially useful because it does not generate diagonal marks and is excellent in performances such as rigidity in a diagonal direction, running stability and fiber supporting property.

In the upper side layer, a design in which an upper side warp passes over an upper side weft, passes under four successive upper side wefts, passes over an upper side weft, and passes under two upper side wefts is repeated so that the rigidity of a wire is improved. In addition, in the upper side layer, an upper side weft has a design in which it passes over three upper side warps and then passes under an upper side warp to form a weft long crimp corresponding to three warps on the upper side so that the resulting fabric has an improved fiber supporting property. Moreover, broken twill weave is preferably adopted as the upper side surface design because it makes it possible to improve the surface property, diagonal rigidity and running stability.

In the textile industry, the term "twill weave" means the weave which has a complete design composed of at least three warps and at least three wefts and in which diagonal ribbed lines appear at intersections (floats) where the warps float continuously. It also embraces the weave in which diagonal lines appear at intersections in which the wefts float continuously. Twill weave with more warps than wefts appearing on the surface is called warp faced, while twill weave with wefts predominating are called weft faced. The twill weave is, in other words, weave in which the design of warps or wefts is shifted uniformly and continuously and floats on the surface are arranged regularly without interruption. The floats are arranged regularly and continuously in the direction of a twill line so that diagonal marks occur easily, a wire itself tends to be stretched in one direction and rigidity in the direction of a twill line tends to be lowered:

The term "broken twill weave" means the weave in which the direction of a diagonal line is reversed every certain number of yarns. In other words, it is the weave in which the design of warps or wefts is not shifted uniformly but the direction of a twill line is reversed when a certain number of twill lines are formed. By employment of this broken twill weave, the regularity of the arrangement of floats on the surface is broken every certain number of yarns so that marks in the diagonal direction hardly occur on the surface of the fabric, a wire is not stretched to a limited direction, and a wire does not meander but runs stably.

In the ordinary twill weave, diagonal lines appear continuously only in a certain direction, while in the broken twill weave, diagonal lines different in angle exist. In the typical example of the present invention, twill lines in the right and left directions appear alternately every four yarns so that a clear diagonal line as found in the twill weave does not appear. Moreover, twill lines in the left and right directions are not connected to each other. When the terminal point of a twill line corresponding to four yarns in the left direction is brought into contact with the starting point of another twill line in the right direction and the terminal point of the another twill line in the right direction is brought into contact with the starting point of a further twill line in the left direction and thus, these twill lines are connected to each other, deterioration in the rigidity of a wire in one direction and generation of diagonal marks, which will otherwise occur in the twill weave, can be prevented, but dog-leg twill lines stand out and their marks appear clearly. In the present invention, the starting point of a twill line and the terminal point of another twill line are therefore not brought into contact with each other in order to suppress the generation of marks caused by adoption of broken twill weave.

The term "knuckle" as used herein means an intersection formed by a warp and a weft crossing each other. In the present invention, the term "knuckle" is defined as follows. On the upper side, the name of a yarn, that is, warp or weft, crossing over the other yarn, that is, weft or warp, is prefixed to a knuckle. Accordingly, a knuckle at which an upper side warp crosses over an upper side weft is called "upper side warp knuckle." On the lower side, on the other hand, the name of a yarn, that is, warp or weft, crossing under the other yarn, that is, weft or warp, is prefixed to a knuckle. Accordingly, a knuckle at which a lower side warp crosses under a lower side weft is called "lower side warp knuckle." A float of a yarn between two adjacent knuckles is called "crimp." Accordingly, a weft crimp is formed between two warp knuckles formed by one weft and two different warps.

According to the design of the present invention, an upper side weft passes over three upper side warps and then passes under an upper side warp to form a weft long crimp corresponding to three warps on the upper side. The conventional example or non-patent document, however, describes that a weft long crimp corresponding three warps cannot be formed without employing a ⅓ design in which an upper side warp passes over an upper side weft and then passes under three upper side wefts. By adopting a ¼-½ design for warps, a fabric superior in wire rigidity to a fabric adopting a ⅓ design for warps can be formed while forming a weft long crimp corresponding to three warps which crimp provides a good fiber supporting property.

When a warp has a ⅓ design in repetition, a weaving power is constant all over the warp. When a warp has a ¼-½ design in repetition, on the other hand, a weaving power becomes greater than that of a ⅓ design. A warp of a ¼-½ design contains a portion of a ½ design in which an upper side warp passes over an upper side weft and then passes under two upper side wefts. In this case, a distance between two adjacent knuckles is close to each other so that a weaving power becomes greater, resulting in improvement of the rigidity of a wire. The closer the distance between two adjacent knuckles formed when a warp crosses over a weft, passes under some wefts and then crosses over a weft, the greater the weaving power. The farther the distance, the smaller the weaving power. This provides an explanation to high rigidity of a fabric with plain weave. The distance between two adjacent knuckles is closer in the ¼-½ design than ⅓ design so that the wire has improved rigidity.

The industrial two-layer fabric of the present invention is composed of eight pairs of warps obtained by vertically stacking eight upper side warps and eight lower side warps and a plurality of upper surface wide wefts and lower side wefts; and uses at least one of the eight upper side warps and lower side warps as a warp binding yarn for binding an upper side weft and a lower side weft. The term "warp binding yarn" means a warp for interweaving an upper side weft and a lower side weft to form a portion of an upper side surface design and a portion of a lower side surface design.

The warp binding yarn is arranged in the following manners: an upper side warp and a lower side warp of at least one pair of eight pairs of an upper side warp and a lower side warp stacked vertically are used as a warp binding yarn, in other words, two warp binding yarns form the at least one pair; at least one of the upper side warps, of eight pairs of an upper side warp and a lower side warp stacked vertically, is used as a warp binding yarn, in other words, a warp binding yarn and a lower side warp form a pair; at least one of the lower side warps, of eight pairs of an upper side warp and a lower side warp stacked vertically, is used as a warp binding yarn, in other words, a warp binding yarn and an upper side warp form a pair. The warp binding yarn used as a pair is preferred because the pair can complement an upper side surface design and a lower side surface design mutually and exhibit a binding effect without destroying it.

In the pair of a warp binding yarn and a lower side warp, the warp binding yarn is woven with an upper side weft and functions as a warp constituting an upper side complete design on the upper side surface, while on the lower side, the warp binding yarn and the lower side warp cooperatively function as a warp which constitutes a lower side surface design.

In the pair of a warp binding yarn and an upper side warp, the warp binding yarn and upper side warp are woven with respective upper side wefts and cooperatively function as a warp constituting an upper side complete design on the upper side surface, while on the lower side, the warp binding yarn and the lower side weft are woven together to function as a warp which constitutes a lower side surface design.

The warp binding yarn and the upper side warp are woven with respective upper side wefts because of the following reason: when the upper side warp and warp binding yarn are woven with the same upper side weft, the upper side warp and warp binding yarn are adjacent to each other and woven with one upper side weft simultaneously so that a water drainage space at that portion becomes narrower than that of the other portions and a water drainage property changes, which facilitates generation of dehydration marks. The warp binding yarn and upper side warp are therefore preferably woven with respective upper side wefts. It is preferred from a similar reason that on the lower side surface, the warp binding yarn and lower side warp are woven with respective lower side wefts.

This also applies to the pair of a warp binding yarn and a lower side warp and the pair of warp binding yarns employed instead of the upper side warp and lower side warp.

In the fabric of the present invention, binding is achieved by a warp binding yarn. The yarn serving as a binding yarn is a warp-direction one constantly under tension. Compared with a conventional thin weft binding yarn, it has a very strong power for binding the upper side layer and the lower side layer and has good adhesion. Accordingly, problems such as weakening of a binding power owing to internal wear caused by friction between these two layers, appearance of a space between layers and separation of two layers scarcely occur. In addition, since an additional binding yarn is not necessary different from a weft binding yarn, it is possible to increase the shooting count of wefts or widen the diameter of a weft, which leads to improvement in the rigidity of a whole fabric.

No particular limitation is imposed on the lower side complete design composed of a warp binding yarn, lower side warp and lower side weft. For example, it may be either a 3/1 design in which a lower side warp passes under a lower side weft and then passes over three successive lower side wefts, or a 4/1-2/1 design in which a lower side warp passes over four lower side wefts, passes under a lower side weft, passes over two lower side wefts and then passes under a lower side weft. Moreover, a fabric excellent in wear resistance can be obtained by shifting the above-described 4/1-2/1 design as needed to form a weft long crimp on the lower side. Thus, the design can be selected as needed, depending on the using purpose or application. As a warp complete design constituting the lower side complete design, one or more may be used. For example, a warp complete design constituting the lower side complete design has a 3/1 design alternating with a 4/1-2/1 design. Another design can also be selected as needed.

Although no particular limitation is imposed on a ratio of the number of warp binding yarns, it is a yarn functioning as a binding yarn so that at least one warp binding yarn must be placed. The fabric of the present invention has eight upper side warps and eight lower side warps stacked vertically so that the four pairs of an upper side warp and a lower side warp, out of eight pairs, are replaced with pairs of warp binding yarns and the pair of warp binding yarns and the pair of an upper side warp and a lower side warp may be arranged alternately; or the pair of a warp binding yarn and a lower side warp and the pair of an upper side warp and a lower side warp may be arranged at a ratio of 1:3. The number of the pairs of warp binding yarns or the number of warp binding yarns may be increased to improve the binding strength. All the warps of the eight pairs may serve as a binding yarn. The ratio of warp binding yarns can be selected as needed, depending on the weaving conditions, using purpose, or the like.

A ratio of an upper side weft and a lower side weft may be 1:1, 2:1, 3:2 or the like. At 2:1 or 3:2 which means that upper side wefts are arranged more densely than lower side wefts, the fabric has improved wear resistance, because the diameter of the lower side weft can be increased easily.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, shenille yarn and yarns obtained by intertwining them. As the cross-section of the yarn, not only circular form but also square or short form such as stellar form, or elliptical or hollow form can be used. The material of the yarn can be selected freely and usable examples of it include polyester, nylon, polyphenylene sulfide, polyvinylidene fluoride, ethylene tetrafluoride, polypropylene, aramid, polyether ether ketone, polyethylene naphthalate, cotton, wool and metal. Of course, yarns obtained using copolymers or incorporating or mixing the above-described material with a substance selected depending on the intended purpose may be used.

As upper side warps, lower side warps, upper side wefts, use of a polyester monofilament having rigidity and excellent dimensional stability is usually preferred. Lower side wefts which need wear resistance are able to have improved wear resistance without losing its rigidity, by arranging polyester monofilaments and polyamide monofilaments alternately and interweaving them. It is also possible to place a plurality of yarns with the same design at a position where a single yarn is normally placed in consideration of the design. Improvement in surface property and thinning of the fabric can be attained by arranging a plurality of yarns having a small diameter.

When the number of upper side wefts is from 1 to 2 times the number of lower side wefts, the diameter of the lower side wefts can be increased, which is effective for improving wear resistance and is therefore preferred.

When the upper side warp and lower side warp are equal in diameter, a warp serving as a binding yarn can form a surface design as one warp without destroying the surface property on the upper side.

EXAMPLES

Examples of the present invention will hereinafter be described based on accompanying drawings.

FIGS. 1, 6, 9, 12, 15, 18, 21, 24 and 27 are design diagrams illustrating the complete design of the examples of the present invention. The term "complete design" as used herein means a minimum repeating unit of a fabric design and a whole fabric design is formed by connecting this complete design longitudinally and latitudinally. In these design diagrams, warps are indicated by Arabic numerals, for example 1, 2 and 3, while wefts are indicated by Arabic numerals with a prime, for example, 1', 2' and 3'.

In these diagrams, a mark "x" in a box means that an upper side warp lies over an upper side weft; a mark "□" in a box indicates that a lower side warp lies under a lower side weft; a mark "●" in a box indicates that a warp binding yarn lies over an upper side weft; a mark "○" in a box indicates that a warp binding yarn lies under a lower side weft; a mark "◆" in a box indicates that a warp binding yarn lies over an upper side weft; and a mark "◇" indicates that a warp binding yarn lies under a lower side weft. Upper side warps and wefts vertically overlap with lower side warps and wefts, respectively. In the design diagram, yarns are vertically overlapped precisely and upper side warps and wefts have, rightly thereunder, lower side warps and wefts, respectively. They are drawn as such for convenience of drawing and misalignment is allowed in the actual fabric.

Example 1

Figure 2A:
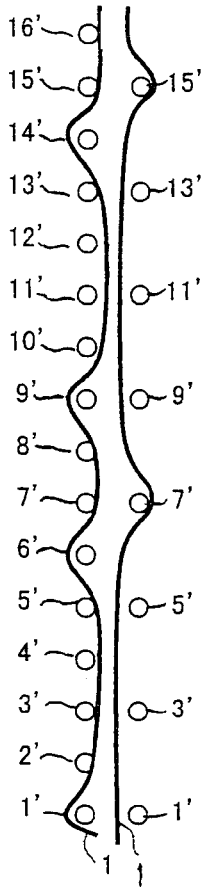
FIGS. 2A and 2B are cross-sectional views taken along the line 2A-2A and 2B-2B at warps 1 and 2 of FIG. 1 respectively.
Figure 2B:
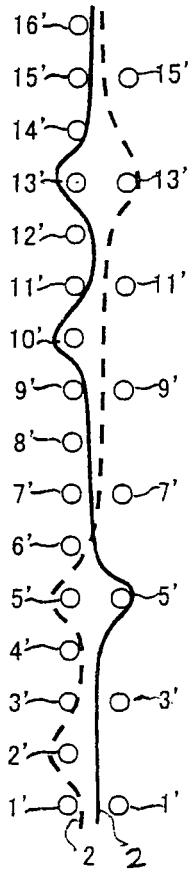
Figure 3:
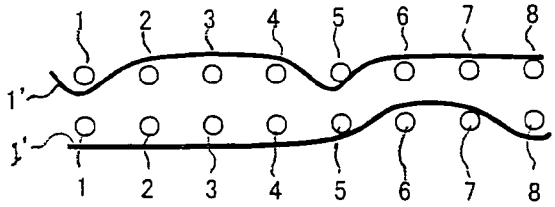
FIG. 3 is a cross-sectional view taken along the line 3-3 at weft 1' of FIG. 1.
Figure 5:
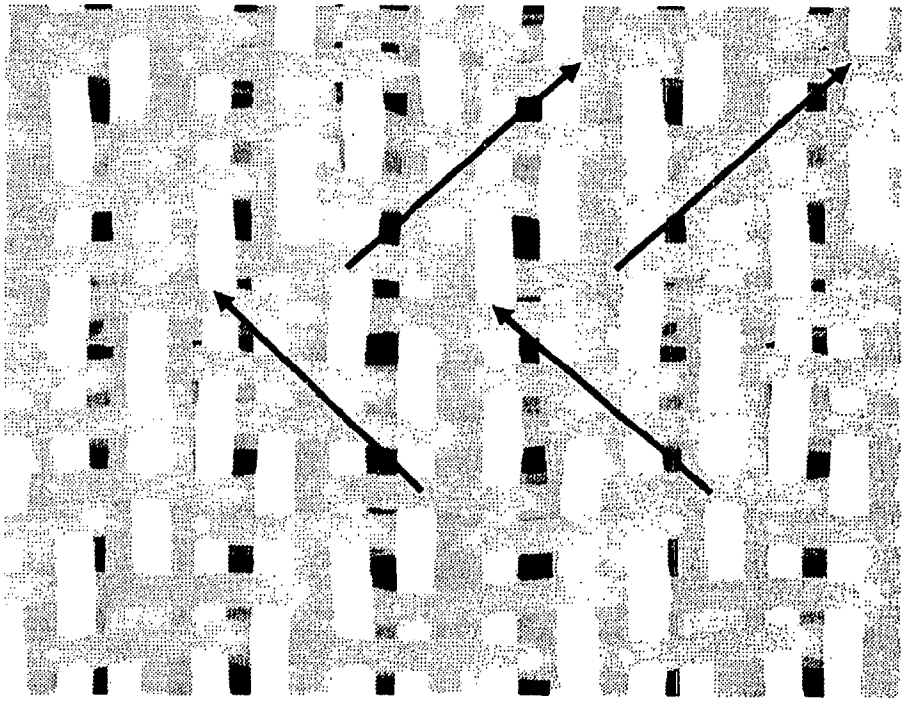
FIG. 5 is a photograph of the upper side surface of a wire woven based on the diagram of FIG. 1.
Figure 4:
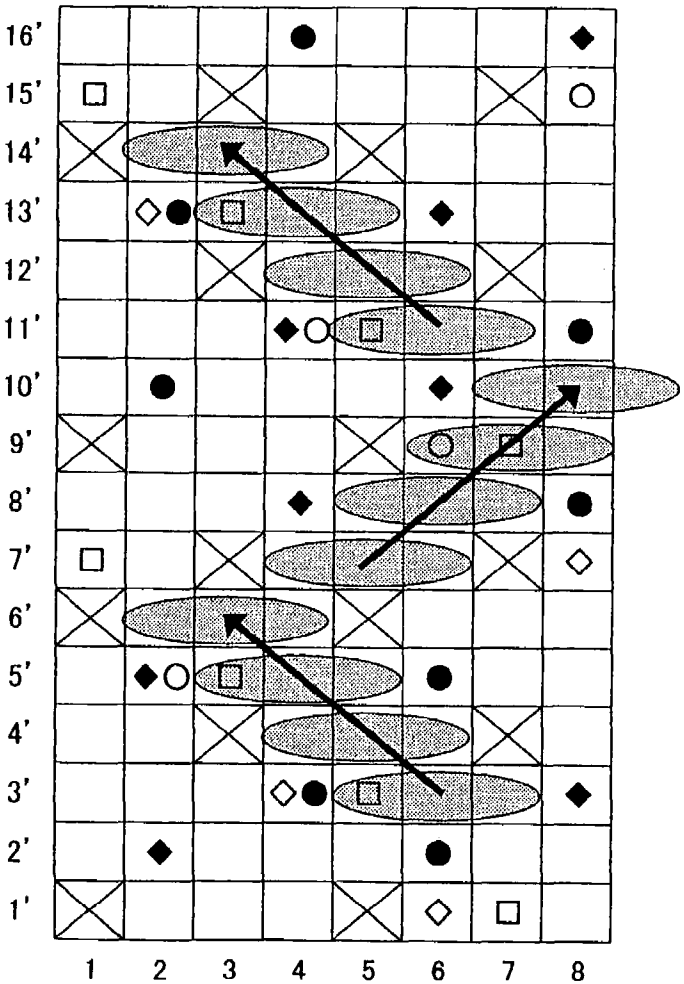
FIG. 4 is a design diagram obtained by adding intersection (float) and direction of a twill line to the design diagram of FIG. 1.

FIG. 1 is a design diagram showing a repeating unit of the complete design of Example 1 of the present invention. FIG. 2 is a cross-sectional view taken along the line 2A-2A and 2B-2B at warps 1 and 2 of FIG. 1 respectively, while FIG. 3 is a cross-sectional view taken along the line 3-3 at a weft 1' of FIG. 1. FIG. 4 is a design diagram obtained by adding an intersection (float) and the direction of a twill line to the design diagram of FIG. 4, and FIG. 5 is a photograph of the upper side surface of a wire woven based on the design diagram of FIG. 1.

In the design diagram of FIG. 1, the warps 1, 3, 5 and 7 of eight pairs of upper side warps 1-8 and lower side warps 1-8 stacked vertically are pairs of upper side warps forming an upper side surface and lower side warps forming a lower side surface stacked vertically, while the warps 2, 4, 6, and 8 are pairs of warp binding yarns which are woven with upper side wefts and lower side wefts to form a portion of an upper side surface design and a portion of a lower side surface design. Wefts indicated by 1', 2', 3' . . . 16' are upper side wefts and lower side wefts. The lower side wefts are located below the upper side wefts of the odd number 1', 3', 5', . . . 15', meaning that their density is half of that of the upper side wefts. Warp binding yarns 2, 4, 6 and 8 are each a yarn for weaving an upper side layer and a lower side layer and they do not break the surface design, because they complement each other to form the upper side surface design by appearing over upper side wefts at the spots shown by the marks "●" and "◆" in FIG. 1 and lower side surface design by appearing under lower side wefts at the spots shown by the marks "○" and "◇" in FIG. 1. The pairs of two warp binding yarns 2, 4, 6 and 8 and the pairs of upper side warps and lower side warps 1, 3, 5 and 7 are placed alternately.

An upper side warp 1, 3, 5 or 7 of the example shown in FIG. 1 has a ¼-½ design in which it passes over an upper side weft at a spot shown by the mark "X" in a box, passes under four successive upper side wefts at spots shown by four following consecutive blank boxes, passes over an upper side weft at a spot shown by a following box with a mark "X" and then passes under two upper side wefts at spots shown by following two consecutive blank boxes. Described specifically, as shown in FIGS. 1 and 2A, upper side warp 1 passes over upper side weft 1', passes under four successive lower side wefts 2', 3', 4' and 5', passes over upper side weft 6' and passes under two upper side wefts 7' and 8'. A distance between knuckles is short in a ½ design so that the wire has improved rigidity.

The conventional example or non-patent document describes, as a design of forming a weft long crimp corresponding to three warps on an upper side, only a ⅓ design in which an upper side warp passes over an upper side weft and then passes under three upper side wefts. A weaving power of a warp formed by the repetition of a ⅓ design is constant, but it is smaller than a weaving power of a warp formed by the repetition of a ¼-½ design according the present invention. When a warp has a ¼-½ design, a warp has a ½ design portion in which it passes over an upper side weft and passes under two upper side wefts. At this portion, a distance between knuckles is short, which increases a weaving power and therefore improves the rigidity of a wire.

An upper side weft passes over three upper side warps and then passes under an upper side warp to form a weft long crimp corresponding three warps on the upper side. As shown in FIGS. 1 and 3, upper side weft 1' passes under upper side warp 1 and then passes over upper side warp and warp binding yarns 2, 3 and 4, thus has a ⅓ design. A weft long crimp corresponding to three warps is formed on the upper side so that the upper side layer has good fiber supporting property.

The upper side surface design using broken twill weave is able to have improved surface property, diagonal rigidity and running stability compared with that using twill weave. According to the non-patent document, the term "twill weave" means the weave which has a complete design composed of at least three warps and at least three wefts and in which diagonal ribbed lines appear at intersections (floats) where the warps float continuously. It also embraces the weave in which diagonal lines appear at intersections in which the wefts float continuously. Twill weave with more intersections of warps than those of wefts floating on the surface called warp faced, that with wefts predominating, weft faced. The twill weave is, in other words, weave in which the design of warps or wefts is shifted uniformly and continuously and floats exist continuously without interruption and are arranged regularly. The floats are arranged regularly and continuously in the direction of a twill line so that diagonal marks can be easily generated, a wire itself tends to be stretched in one direction and rigidity in the direction of a twill line tends to be lowered.

The term "broken twill weave" means the weave in which the direction of a diagonal line is reversed every certain number of yarns. In other words, it is the weave in which the design of warps or wefts is not shifted regularly but the direction of a twill line is reversed when a certain number of twill lines are formed. By employment of this broken twill weave, the regularity of the arrangement of floats on the surface is broken every certain number of yarns so that marks in the diagonal direction hardly occur on the surface of the fabric. Moreover, a wire is not stretched to a limited direction, and a wire does not meander but runs stably.

In the Example of FIG. 1, a weft long crimp corresponding to three warps is formed on the upper side. This design is not shifted uniformly, but the direction of a twill line is changed every four yarns so that the pattern thus obtained is a broken one of weft faced weave.

The ellipses in FIG. 4 of this Example indicate intersections (floats) floating continuously and the arrows in FIG. 4 and arrows drawn on the photograph of the surface of a woven wire in FIG. 5 indicate the direction and length of diagonal lines formed by broken twill weave. In the conventional twill weave, diagonal lines appear continuously in a certain direction, while in broken twill weave, diagonal lines different in angle appear. Referring to FIG. 4, a weft-direction float corresponding to three warps is formed by upper side weft 3' crossing over upper side warps and warp binding yarns 5, 6 and 7; floats in the weft direction are formed, respectively, by upper side weft 4' crossing over upper side warp and warp binding yarns 4, and 6, upper side weft 5' crossing over upper side warps and the warp binding yarns 3, 4 and 5, and the upper side weft 6' crossing over upper side warp and the warp binding yarns 2, 3 and 4, whereby a twill line corresponding to four yarns is formed in the left direction. In addition, floats corresponding to three warps are formed in the weft direction by the upper side weft 7' crossing over the upper side warp and warp binding yarns 4, 5 and 6. Floats in the weft direction are then formed by the upper side weft 8' crossing over the upper side warps and warp binding yarns 5, 6 and 7, the upper side weft 9' crossing over the upper side warp and warp binding yarns 6, 7 and 8 and upper side weft 10' crossing over the upper side warps and warp binding yarns 7, 8 and 1, respectively. A continuous twill line corresponding to four yarns is formed in a right direction, opposite to the above-described twill line. The direction of the twill line is changed every four yarns so that a clear diagonal line as is formed in a twill weave does not appear.

Diagonal lines different in angle will next be described using the arrow in FIG. 4 which is drawn at the center of the ellipse showing the portion of a float and indicates the direction of a twill line. From the left-directional twill line corresponding to four yarns and extending from the intersection between upper side weft 3' and warp binding yarn 6 to the intersection between upper side weft 6' and upper side warp 3 and the right-directional twill line corresponding to four yarns and extending from the intersection between the upper side weft 7' and the upper side warp 5 to the intersection between the upper side weft 10' and warp binding yarn 8, it has been understood that the terminal point of the left-directional twill line formed by upper side weft 6' and the upper side warp 3 is not brought into contact with the starting point of the right-directional twill line formed by the upper side weft 7' and upper side warp 5. When the terminal point of a left-directional twill line corresponding to four yarns is brought into contact with the starting point of a right-directional twill line and the terminal point of the right-directional twill line is brought into the starting point of another left-directional twill line and these twill lines are connected to each other, a dog-leg like twill line appears and its mark stands out even if a reduction in the rigidity of a wire in one direction and generation of diagonal marks, which will otherwise occur in twill weave, can be suppressed. In this Example, contact between the terminal point of a twill line and the starting point of a subsequent twill line is avoided in order to suppress the influence of marks resulting from the deformation of a twill line.

As a result, marks in the diagonal direction do not appear, easy stretching of a wire to one direction is prevented, and the wire has good running stability without meandering during running.

One of warp binding yarns forming a pair is woven with at least one upper side weft to form an upper side surface design, under which the other warp binding yarn is woven with a lower side weft, while the one of the warp binding yarns is woven with a lower side weft, over which the other warp binding yarn is woven with at least one upper side weft, whereby they cooperatively form the upper side surface design which is similar to the ¼-½ design formed by an upper side warp. The lower side design is similar to that formed by a lower side warp. As shown in FIGS. 1 and 2B, one of the warp binding yarns 2 forming a pair passes over the upper side weft 2', passes under the upper side wefts 3' and 4' and passes over the upper side weft 5', under which the other warp binding yarn is woven with lower side weft 5', while the one of warp binding yarns is woven with the lower side weft 13', over which the other warp binding yarn passes over the upper side weft 10', passes under the upper side wefts 11' and 12' and then crosses over the upper side weft 13'. As the upper side surface design, a ¼-½ design is formed and as the lower side surface design, a ⅗ design is formed. Thus, the warp binding yarns 2, 4, 6 and 8 forming a pair complement each other to form the upper side surface design and lower side surface design.

A lower side warp passes over three lower side wefts and then passes under a lower side weft, thus forming a ⅗ design. Since a warp binding yarn and a lower side warp simultaneously weave a lower side weft from the lower side, the resulting fabric has improved rigidity, and the formation of a weft long crimp corresponding to six lower side warps on the lower side surface leads to improvement in wear resistance. As shown in FIG. 1, warp binding yarn 2 and lower side warp 3 adjacent to each other weave lower side wefts 5' and 13' at the boxes with "○" and "□" simultaneously from the lower side, whereby lower side wefts 5' and 13' pass over warp binding yarn 2 and lower side warp 3. Then, they pass under six successive lower side warps and warp binding yarns 4, 5, 6, 7, 8 and 1, at the blank boxes and the boxes with "◆" which suggests the formation of a weft long crimp corresponding to the six lower side warps.

By employment of the above-described designs of the present invention, the fabric has improved rigidity, diagonal rigidity, wear resistance and surface property, does not generate marks in the diagonal direction, and has excellent running stability of a wire and fiber supporting property.

Example 2

Figure 6:
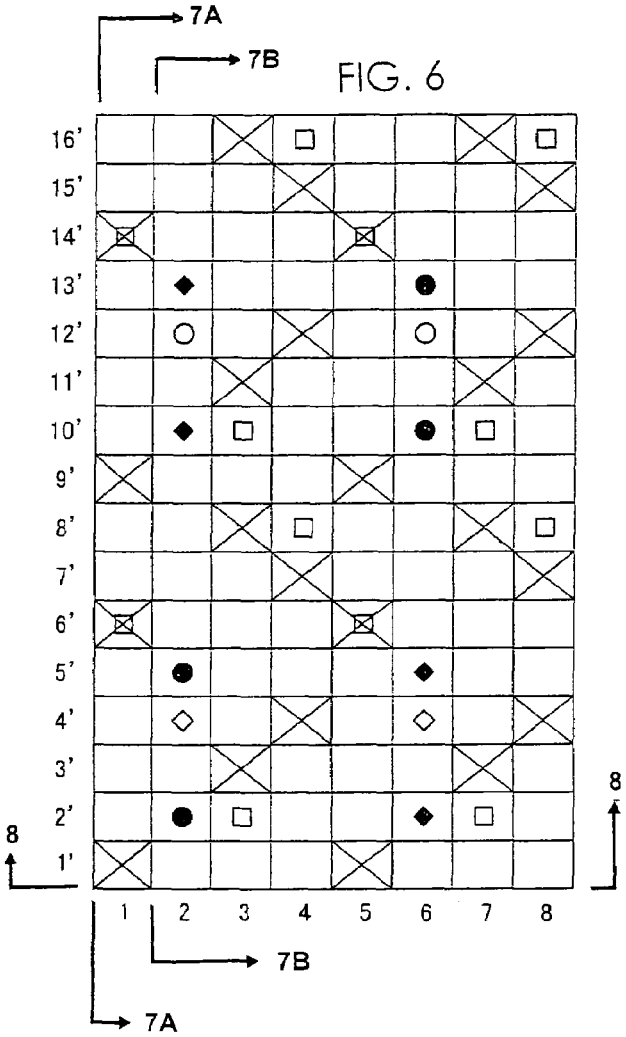
FIG. 6 is a design diagram illustrating a repeating unit of the complete design of Example 2 of the present invention.
Figure 7A:
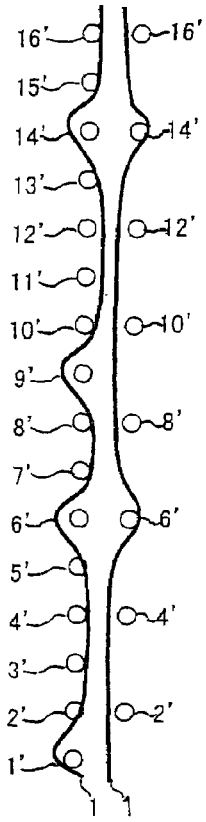
FIGS. 7A and 7B are cross-sectional views taken along the lines 7A-7A and 7B-7B at warps 1 and 2 of FIG. 6 respectively.
Figure 7B:
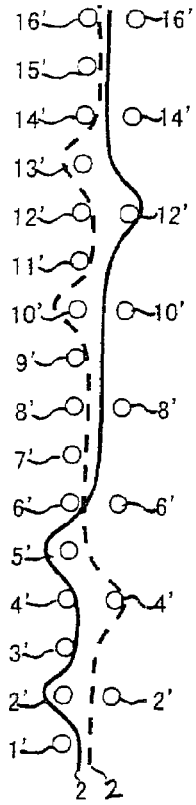
Figure 8:
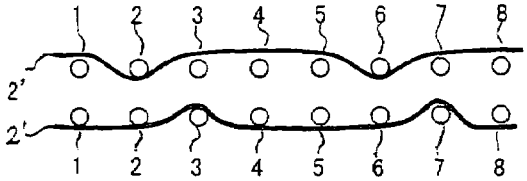
FIG. 8 is a cross-sectional view taken along the line 8-8 at weft 2' of FIG. 6.

FIG. 6 is a design diagram illustrating a repeating unit of the complete design of Example 2 of the present invention. FIGS. 7A and 7B are cross-sectional views taken along the lines 7A-7A and 7B-7B at warps 1 and 2 of FIG. 6 respectively, while FIG. 8 is a cross-sectional view taken along the line 8-8 at weft 2' of FIG. 6.

In the design diagram of FIG. 6, of eight pairs of upper side warps and lower a surface side warps stacked vertically, pairs indicated by 1, 3, 4, 5, 7 and 8 are those of upper side warps and lower side warps, and pairs indicated by 2 and 6 are pairs of warp binding yarns.

In the pair 2 of the warp binding yarns, as shown in FIG. 7B, the first warp binding yarn $\mathbf{2}_{B\text{-}1}$ shown in a solid line passes between the upper side layer and lower side layer at upper and lower side weft 1', passes over the upper side weft 2', passes between the upper side layer and lower side layer at the upper and lower side wefts 3' and 4', passes over the upper side weft 5', passes between the upper side layer and lower side layer at the upper and lower side wefts 6' to 11', passes under the lower side weft 12' and passes between the upper side layer and lower side layer at the upper and lower side weft 13' to 16', while the other second warp binding yarn $\mathbf{2}_{B\text{-}2}$ shown in a broke line passes between the upper side layer and lower side layer at the upper and lower side wefts 1' to 3', passes under the lower side weft 4', passes between the upper side layer and lower side layer at the upper and lower side wefts 5' to 9', passes over the upper side weft 10', passes between the upper side layer and lower side layer at the upper and lower side wefts 11' and 12', passes over the upper side weft 13' and passes between the upper side layer and lower side layer at the upper and lower side wefts 14' to 16'. Thus, the pair 2 of the warp binding yarns cooperatively form, on the upper side surface, the upper side surface design similar to that formed by another upper side warp.

The pairs 2 and 6 of warp binding yarns and pairs 1, 3, 4, 5, 7 and 8 of upper side warps and lower side warps are arranged at a ratio of 1:3. Upper side wefts and lower side wefts are arranged at a ratio of 2:1. Similar to Example 1, warp binding yarns 2 and 6 are yarns for weaving the upper side layer and lower side layer. Warp binding yarns 2 and 6 are making a pair complement each other to form the upper side surface design and the lower side surface design so that they do not break the surface design. A ¼-½ design employed for upper side warps improves the rigidity of a wire, while a ⅗ design employed for upper side wefts contributes to the formation of a fabric having an excellent fiber supporting property. In addition, adoption of broken twill weave prevents generation of diagonal lines and therefore prevents generation of marks in the diagonal direction and meandering of a wire. Moreover, by employing a ⅗ design for the lower side layer and forming a weft long crimp corresponding to three warps on the lower side surface, the resulting fabric has excellent wear resistance and has improved fabric rigidity and diagonal rigidity.

Example 3

Figure 9:
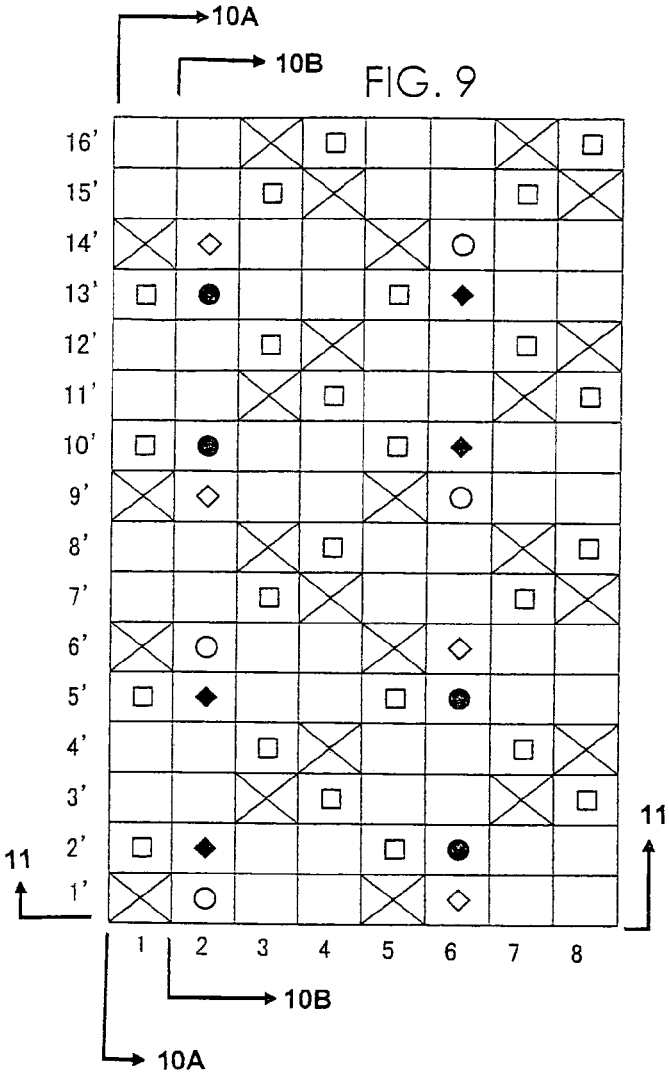
FIG. 9 is a design diagram illustrating a repeating unit of the complete design of Example 3 of the present invention.
Figure 10A:
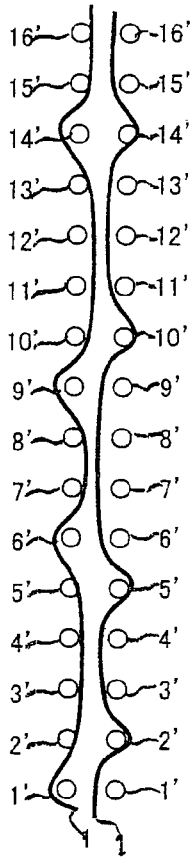
FIGS. 10A and 10B are cross-sectional views taken along the lines 10A-10A and 10B-10B at warps 1 and 2 of FIG. 9 respectively.
Figure 10B:
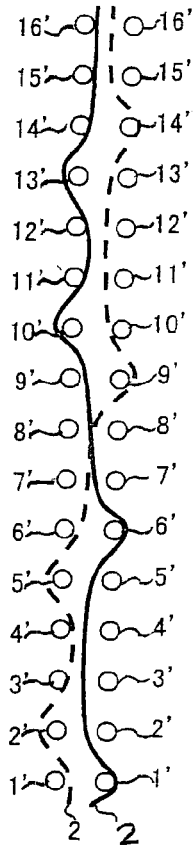
Figure 11:
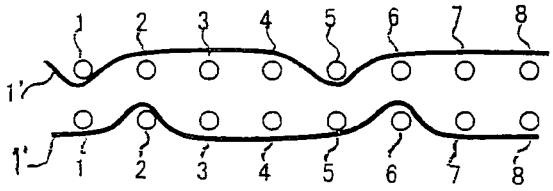
FIG. 11 is a cross-sectional view taken along the line 11-11 at weft 1' of FIG. 9.

FIG. 9 is a design diagram illustrating a repeating unit of the complete design of Example 3 of the present invention. FIGS. 10A and 10B are cross-sectional views taken along the lines 10A-10A and 10B-10B at warps 1 and 2 of FIG. 9 respectively, while FIG. 11 is a cross-sectional view taken along the line 11-11 at weft 1' of FIG. 9.

In the design diagram of FIG. 9, of the eight pairs of upper side warps and lower side warps stacked vertically, pairs indicated by 1, 3, 4, 5, 7 and 8 are those of upper side warps and lower side warps, and pairs indicated by 2 and 6 are those of warp binding yarns.

In the pair 2 of the warp binding yarns, as shown in FIG. 10B, the first warp binding yarn $\mathbf{2}_{B\text{-}1}$ shown in a broken line passes between the upper side layer and lower side layer at the upper side weft 1', passes over the upper side weft 2', passes between the upper side layer and lower side layer at the upper and the lower side wefts 3' and 4', passes over the upper side weft 5', passes between the upper side layer and lower side layer at the upper side wefts 6' to 8', passes under the lower side weft 9', passes between the upper side layer and lower side layer at the upper and lower side wefts 10' to 13', passes under the lower side weft 14' and passes between the upper side layer and lower side layer at upper and lower side wefts 15' and 16', while the other second warp binding yarn $\mathbf{2}_{B\text{-}2}$ shown in a solid line passes under the lower side weft 1', between the upper side layer and lower side layer at the upper and lower side wefts 2' to 5', passes under the lower side weft 6', passes between the upper side layer and lower side layer at the upper and lower side wefts 7' to 9', passes over the upper side weft 10' passes between the upper side layer and lower side layer at the upper and lower side wefts 11' and 12', passes over the upper side weft 13' and passes between the upper side layer and lower side layer at the upper and lower side weft 14' to 16'. Thus, the pair 2 of the warp binding yarns cooperatively form, on the upper side surface, the upper side surface design similar to that formed by other upper side warps.

Pairs 2 and 6 of warp binding yarns and pairs 1, 3 to 5, 7 and 8 of upper side warps and lower side warps are arranged at a ratio of 1:3. Upper side wefts and lower side wefts are arranged at a ratio of 1:1. A ¼-½ design is adopted for upper side warps so that the rigidity of a wire is improved, while a ⅗ design is adopted for upper side wefts so that a weft long crimp corresponding to three warps is formed on the upper side surface and the resulting fabric has an excellent fiber supporting property. In addition, employment of broken twill weave prevents generation of diagonal lines and therefore, prevents generation of marks in the diagonal direction and meandering of a wire. Moreover, owing to the employment of a ⅘-⅖ design for lower side warps and proper shifting to form a weft long crimp corresponding to three lower side warps on the lower side surface, the resulting fabric has excellent wear resistance. Broken twill weave is also employed for the lower side so that a twill line on this side is contrary to that on the upper side. The resulting fabric therefore has excellent diagonal rigidity and running stability of a wire.

Example 4

Figure 12:
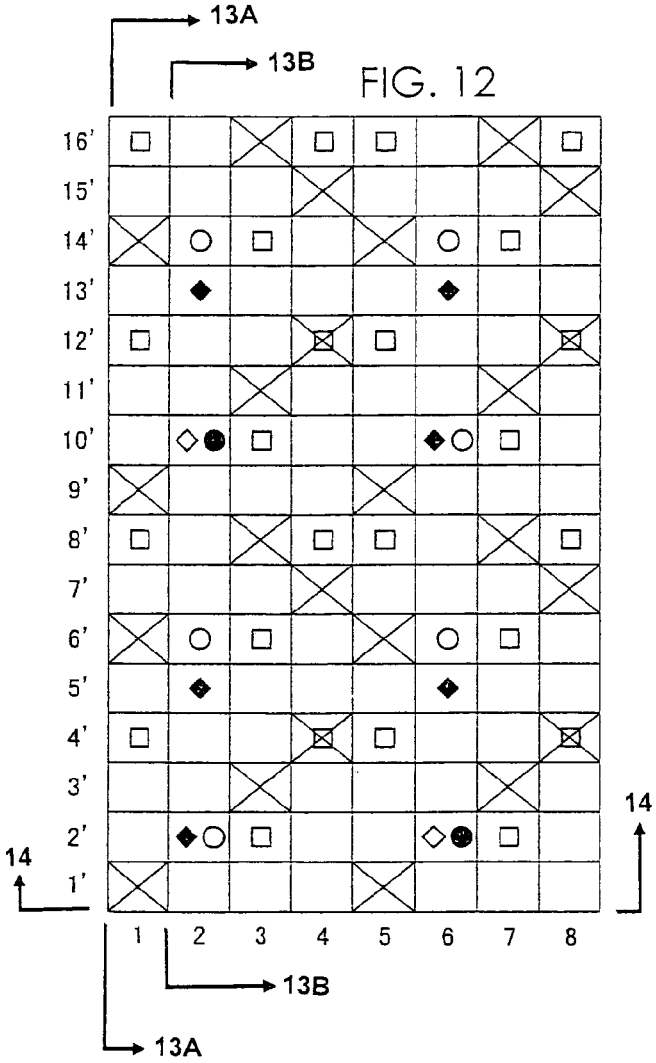
FIG. 12 is a design diagram illustrating a repeating unit of the complete design of Example 4 of the present invention.
Figure 13A:
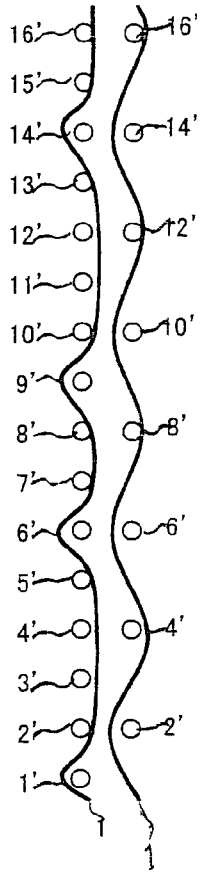
FIGS. 13A and 13B are cross-sectional views taken along the lines 13A-13A and 13B-13B at warps 1 and 2 of FIG. 12 respectively.
Figure 13B:
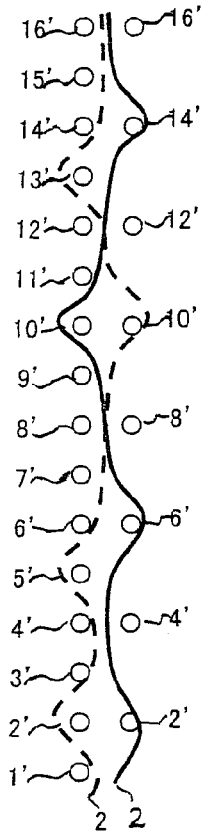
Figure 14:
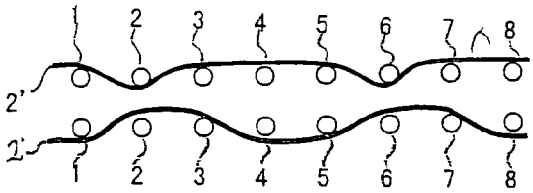
FIG. 14 is a cross-sectional view taken along the line 14-14 at weft 2' of FIG. 12.

FIG. 12 is a design diagram illustrating a repeating unit of the complete design of Example 4 of the present invention. FIGS. 13A and 13B are cross-sectional views taken along the lines 13A-13A and 13B-13B at warps 1 and 2 of FIG. 12 respectively, while FIG. 14 is a cross-sectional view taken along line 14-14 at the weft 2' of FIG. 12.

In the design diagram of FIG. 12, of the eight pairs of upper side warps and lower side warps stacked vertically, the pairs indicated by 1, 3, 4, 5, 7 and 8 are those of upper side warps and lower side warps, and the pairs indicated by 2 and 6 are those of warp binding yarns.

In the pair 2 of the warp binding yarns, as shown in FIG. 13B, the first warp binding yarn $\mathbf{2}_{B\text{-}1}$ shown in a broken line passes between the upper side layer and lower side layer at the upper side weft 1', passes over the upper side weft 2', passes between the upper side layer and lower side layer at the upper and the lower side wefts 3' and 4', passes over the upper side weft 5', passes between the upper side layer and lower side layer at the upper side wefts 6' to 9', passes under the lower side weft 10', passes between the upper side layer and lower side layer at the upper and lower side wefts 11' and 12', passes over upper side weft 13' and passes between the upper side layer and lower side layer at the upper and lower side wefts 14' and 16', while the other second warp binding yarn $\mathbf{2}_{B\text{-}2}$ shown in a solid line passes under the lower side weft 1', passes under the lower side weft 2', passes between the upper side layer and lower side layer at the upper side wefts 3' to 5', passes under the lower side weft 6', passes between the upper side layer and lower side layer at the upper side wefts 7' to 9', passes over the upper side weft 10' passes between the upper side layer and lower side layer at the upper side wefts 11' to 13', passes under the lower side weft 14' and passes between the upper side layer and lower side layer at the upper side wefts 15' and 16'. Thus, the pair 2 of the warp binding yarns cooperatively form, on the upper side surface, the upper side surface design similar to that formed by another upper side warp.

The pairs 2 and 6 of warp binding yarns and the pairs 1, 3 to 5, 7 and 8 of upper side warps and lower side warps are arranged at a ratio of 1:3. Upper side wefts and lower side wefts are arranged at a ratio of 2:1. A ¼-½ design employed for upper side warps improves the rigidity of a wire, while a 3/1 design employed for upper side wefts contributes to the formation of a fiber having an excellent fiber supporting property. In addition, adoption of broken twill weave prevents generation of diagonal lines and therefore prevents generation of marks in the diagonal direction and meandering of a wire. Since ribbed weave is employed for the lower side layer, the resulting fabric has improved wire rigidity and running stability.

Example 5

Figure 15:
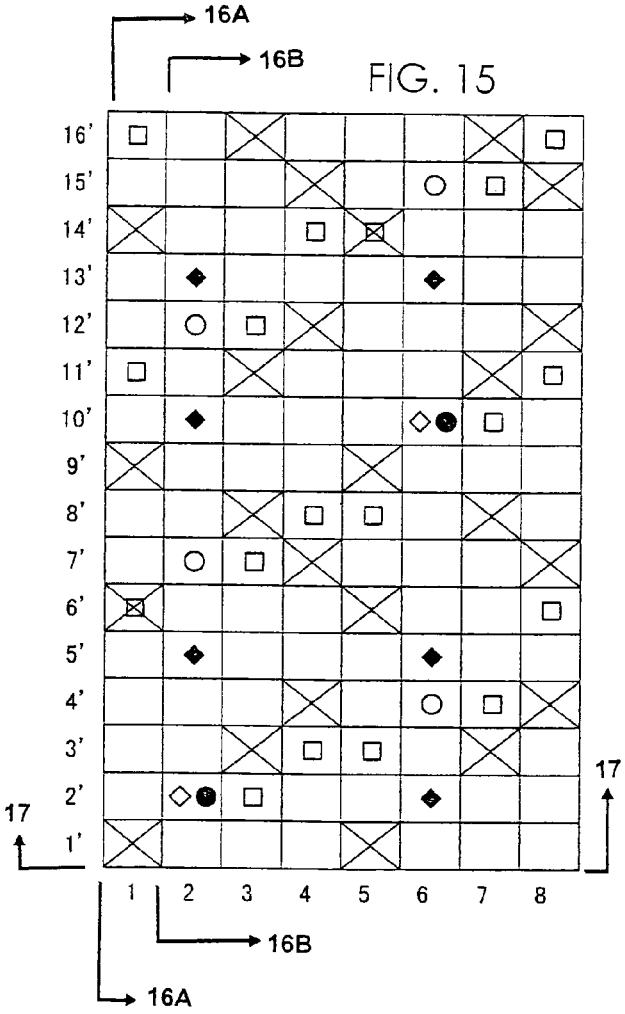
FIG. 15 is a design diagram illustrating a repeating unit of the complete design of Example 5 of the present invention.
Figure 16A:
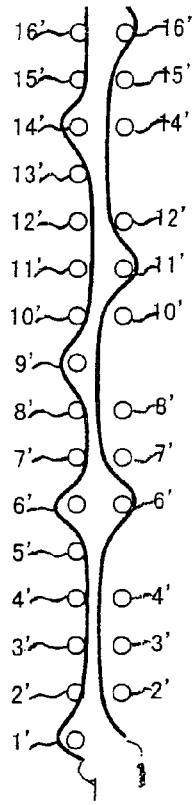
FIGS. 16A and 16B are cross-sectional views taken along the lines 16A-16A and 16B-16B at warps 1 and 2 of FIG. 15 respectively.
Figure 16B:
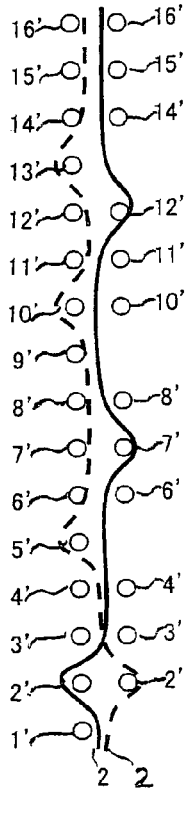
Figure 17:
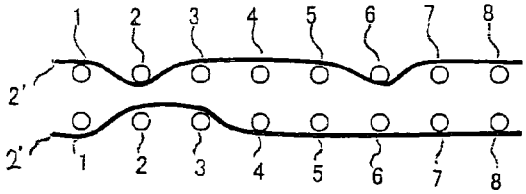
FIG. 17 is a cross-sectional view taken along the line 17-17 at weft 2' of FIG. 15.

FIG. 15 is a design diagram illustrating a repeating unit of the complete design of Example 5 of the present invention. FIGS. 16A and 16B are cross-sectional views taken along the lines 16A-16A and 16B-16B at warps 1 and 2 of FIG. 15 respectively, while FIG. 17 is a cross-sectional view taken along the line 17 at weft 2' of FIG. 15.

In the design diagram of FIG. 15, of the eight pairs of upper side warps and lower side warps stacked vertically, pairs indicated by 1, 3, 4, 5, 7 and 8 are those of upper side warps and lower side warps and pairs indicated by 2 and 6 are those of warp binding yarns.

In the pair 2 of the warp binding yarns, as shown in FIG. 16B, the first warp binding yarn $\mathbf{2}_{B\text{-}1}$ shown in a solid line passes between the upper side layer and lower side layer at the upper side weft 1', passes over the upper side weft 2', passes between the upper side layer and lower side layer at upper side wefts 3' to 6', passes under the lower side weft 7', passes between the upper side layer and lower side layer at upper side wefts 8' to 11', passes under the lower side weft 12' and passes between the upper side layer and lower side layer at the upper side wefts 13' to 16', while the other second warp binding yarn $\mathbf{2}_{B\text{-}2}$ shown in a broken line passes between the upper side layer and lower side layer at the upper side weft 1', passes under lower side weft 2', passes between the upper side layer and lower side layer at the upper side wefts 3' and 4', passes over the upper side weft 5', passes between the upper side layer and lower side layer at the upper side wefts 6' to 9', passes over the upper side weft 10' passes between the upper side layer and lower side layer at the upper side wefts 11' and 12', passes over the upper side weft 13' and passes between the upper side layer and lower side layer at the upper side wefts 14' to 16'. Thus, the pair 2 of the warp binding yarns cooperatively form, on the upper side surface, the upper side surface design similar to that formed by another upper side warp.

Pairs 2 and 6 of warp binding yarns and pairs 1, 3 to 5, 7 and 8 of upper side warps and lower side warps are arranged at a ratio of 1:3. Upper side wefts and lower side wefts are arranged at a ratio of 4:3. A ¼-½ design employed for upper side warps improves the rigidity of a wire, while a 3/1 design employed for upper side wefts contributes to the formation of a fabric having an excellent fiber supporting property. In addition, since broken twill weave is adopted, generation of diagonal lines is prevented and therefore, generation of marks in the diagonal direction and meandering of a wire are prevented. Moreover, owing to the adoption of a 3/1 design for lower side warps and proper shifting to form a weft long crimp corresponding to six lower side warps on the lower side surface, the resulting fabric has excellent wear resistance.

Example 6

FIG. 18 is a design diagram illustrating a repeating unit of the complete design of Example 6 of the present invention. FIGS. 19A, 19B and 19C are cross-sectional views taken along the lines 19A-19A, 19B-19B and 19C-19C at warps 1, 2 and 3 of FIG. 18 respectively, while FIG. 20 is a cross-sectional view taken along the line 20-20 at weft 2' of FIG. 18.

In the design diagram of FIG. 18, of the eight pairs of upper side warps and lower side warps stacked vertically, pairs indicated by 1, 3, 4, 5, 7 and 8 are those of upper side warps and lower side warps and pairs indicated by 2 and 6 are those of warp binding yarns.

In the pair 2 of the warp binding yarns, as shown in FIG. 19B, the first warp binding yarn $\mathbf{2}_{B\text{-}1}$ shown in a broken line passes between the upper side layer and lower side layer at the upper side wefts 1' to 3', passes over the upper side weft 4', passes between the upper side layer and lower side layer at upper side wefts 5' and 6', passes over the upper side weft 7', passes between the upper side layer and lower side layer at upper side wefts 8' to 11', passes under the lower side weft 12' and passes between the upper side layer and lower side layer at the upper side wefts 13' to 16', while the other second warp binding yarn $\mathbf{2}_{B\text{-}2}$ shown in a solid line passes between the upper side layer and lower side layer at the upper side wefts 1' to 3', passes under lower side weft 4', passes between the upper side layer and lower side layer at the upper side wefts 5' to 11', passes over the upper side weft 12', passes between the upper side layer and lower side layer at the upper and lower side wefts 13' and 14', passes over the upper side weft 15' and passes between the upper side layer and lower side layer at the upper side weft 16'. Thus, the pair 2 of the warp binding yarns cooperatively form, on the upper side surface, the upper side surface design similar to that formed by another upper side warp.

The pairs 2 and 6 of warp binding yarns and the pairs 1, 3 to 5, 7 and 8 of upper side warps and lower side warps are arranged at a ratio of 1:3. Upper side wefts and lower side wefts are arranged at a ratio of 2:1. A ¼-½ design employed for upper side warps improves the rigidity of a wire, while a 3/1 design employed for upper side wefts contributes to the formation of a fabric excellent in a fiber supporting property. By employing broken twill weave, generation of diagonal lines is prevented and therefore, generation of marks in the diagonal direction and meandering of a wire are prevented. Three designs, that is, 4/1-2/1 design, 3/1 design and 5/1-1/1 design are employed for warps forming the lower side layer and a lower side warp and a warp binding yarn, or two lower side warps adjacent to each other simultaneously weave a lower side weft from the lower side, which improves the rigidity of the fabric. In addition, owing to the formation, by a lower side warp, of a long weft crimp corresponding to six lower side warps on the lower side surface, the resulting fabric has improved wear resistance.

Example 7

Figure 21:
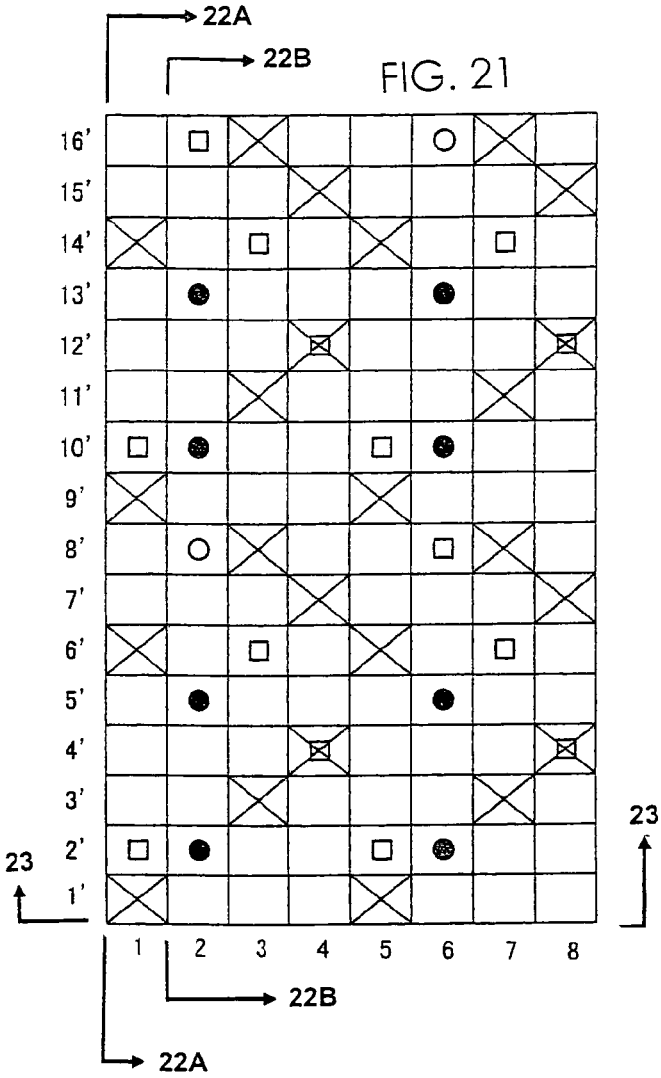
FIG. 21 is a design diagram illustrating a repeating unit of the complete design of Example 7 of the present invention.
Figure 22A:
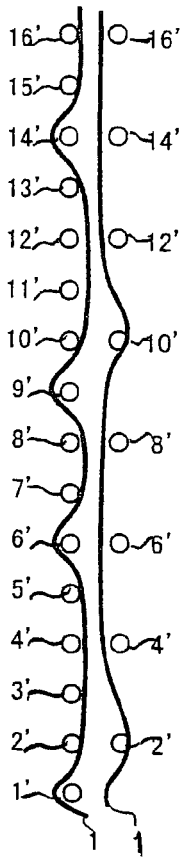
FIGS. 22A and 22B are cross-sectional views taken along the lines 22A-22A and 22B-22B at warps 1 and 2 of FIG. 21 respectively.

FIG. 21 is a design diagram illustrating a repeating unit of the complete design of Example 7 of the present invention. FIG. 22 is a cross-sectional view taken along warps 1 and 2 of FIG. 21, while FIG. 23 is a cross-sectional view taken along weft 2' of FIG. 21.

In the diagram of FIG. 21, of the eight pairs of upper side warps and lower side warps stacked vertically, pairs indicated by 1, 3, 4, 5, 7 and 8 are those of upper side warps and lower side warps, and pairs indicated by 2 and 6 are those of warp binding yarns substituted for upper side warps and lower side warps. Warp binding yarns are used instead of the upper side warps of pairs 2 and 6 and they are woven with upper side wefts and lower side wefts 4' and 12' respectively to form a portion of the upper side surface design and a portion of the lower side surface design. In the pairs 2, 6 of warp binding yarns and lower side warps, the warp binding yarns are woven with upper side wefts to serve as warps constituting the upper side complete design on the upper side surface, while on the lower side, the warp binding yarns and lower side warps cooperatively form the lower side surface design similar to that formed by another lower side warp.

Figure 22B:
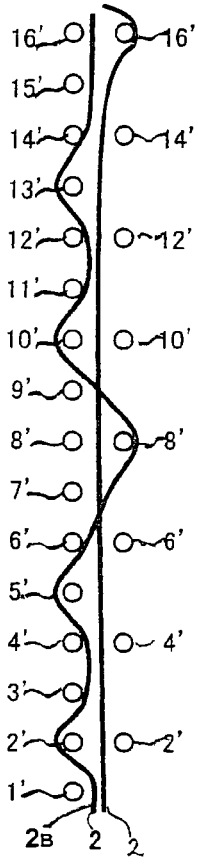
Figure 23:
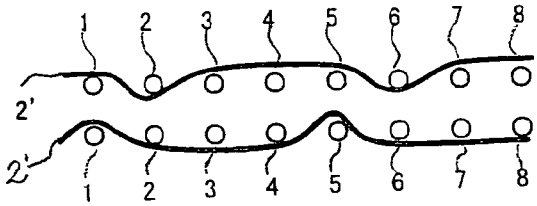
FIG. 23 is a cross-sectional view taken along the line 23-23 at weft 2' of FIG. 21.

In the pair 2 of a warp binding yarn and a lower side warp, as shown in FIG. 22B, the warp binding yarn $\mathbf{2}_B$ passes over upper side weft 2', passes between the upper side layer and lower side layer at the upper side wefts 3' and 4', passes over upper side weft 5', passes between the upper side layer and lower side layer at upper side wefts 6' and 7', passes under the lower side weft 8', passes between the upper side layer and lower side layer at upper side weft 9', passes over upper side weft 10', passes between the upper side layer and lower side layer at upper side wefts 11' and 12', passes over upper side weft 13', and passes between the upper side layer and the lower side layer at upper side wefts 14' to 16' and 1', while the lower side warp $\mathbf{2}_L$ passes between the upper side layer and lower side layer at the upper side wefts 2' to 15' and the lower side wefts 2', 4', 6', 8', 10', 12' and 14', and passes under the lower side weft 16'. Thus, the pair 2 of the lower side warp and warp binding yarn cooperatively form, on the lower side surface, the lower side surface design similar to that formed by another lower side warp.

In this Example, the pairs 2, 6 of a warp binding yarn and a lower side warp and pairs 1, 3 to 5, 7 and 8 of upper side warps and lower side warps are arranged at a ratio of 1:3. Upper side wefts and lower side wefts are arranged at a ratio of 2:1. A ¼-⅔ design employed for upper side warps improves the rigidity of a wire, while a ⅗ design employed for upper side wefts contributes to the formation of a fabric excellent in a fiber supporting property. In addition, employment of broken twill weave prevents generation of diagonal lines and therefore prevents generation of marks in the diagonal direction and meandering of a wire. The fabric obtained in Examples 1 to 6 has at least one pair of warp binding yarns in its complete design, however, the fabric obtained in this Example does not have a pair of warp binding yarns but has two pairs of a warp binding yarn and a lower side warp. Such a fabric having a pair of a warp binding yarn and a lower side warp as in this Example is not inferior in binding power.

Example 8

Figure 24:
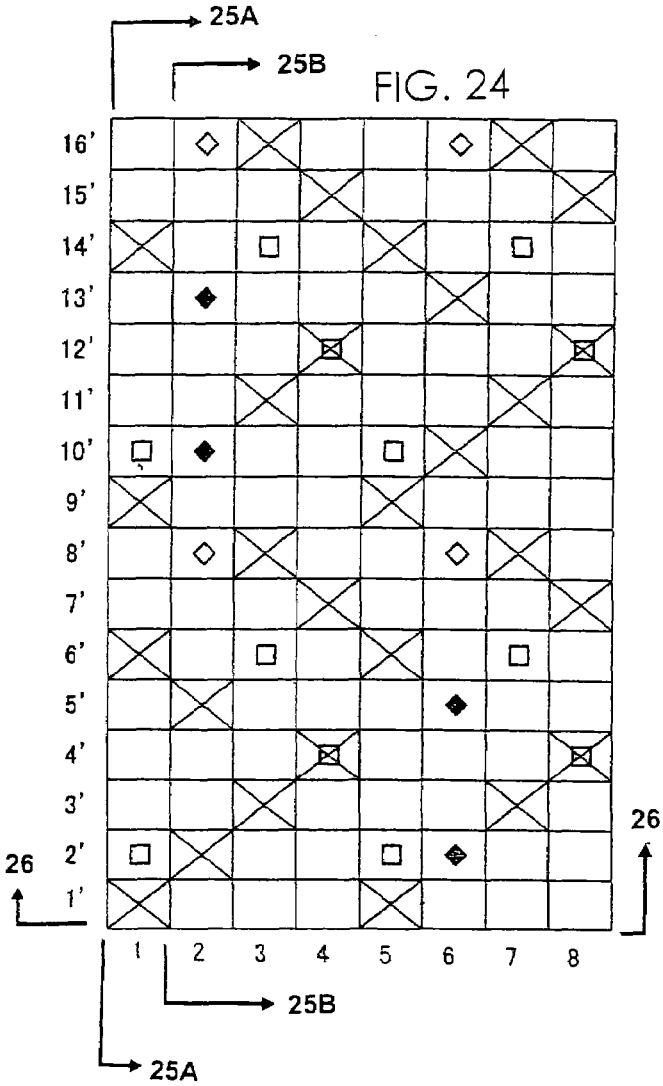
FIG. 24 is a design diagram illustrating a repeating unit of the complete design of Example 8 of the present invention.
Figure 25A:
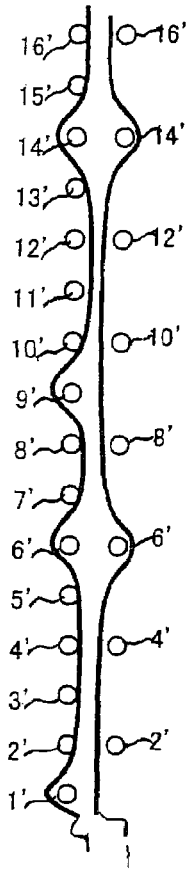
FIGS. 25A and 25B are cross-sectional views taken along the lines 25A-25A and 25B-25B at warps 1 and 2 of FIG. 24 respectively.
Figure 25B:
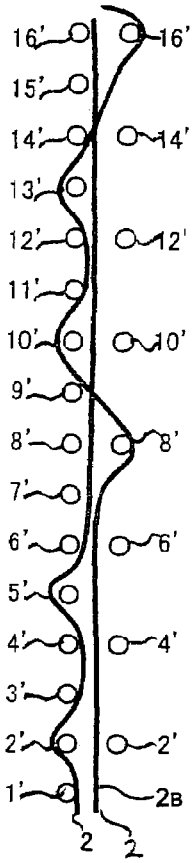
Figure 26:
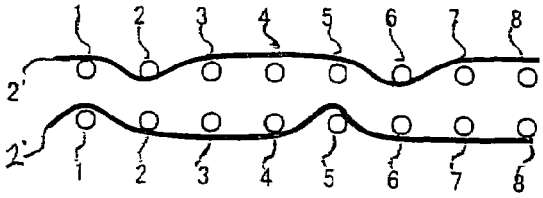
FIG. 26 is a cross-sectional view taken along the line 26-26 at weft 2' of FIG. 24.

FIG. 24 is a design diagram illustrating a repeating unit of the complete design of Example 8 of the present invention. FIGS. 25A and 25B are cross-sectional views taken along the lines 25A-25A and 25B and 25B at warps 1 and 2 of FIG. 24, while FIG. 26 is a cross-sectional view taken along the line 26-26 at weft 2' of FIG. 24.

In the design diagram of FIG. 24, of the eight pairs of upper side warps and lower side warps stacked vertically, pairs indicated by 1, 3, 4, 5, 7 and 8 are those of upper side warps and lower side warps, while pairs indicated by 2 and 6 are those of warp binding yarns substituted for lower side warps and upper side warps. The lower side warps of pairs 2 and 6 are replaced by warp binding yarns which are woven with upper side wefts and lower side wefts to form a portion of an upper side surface design and a portion of a lower side surface design. In the pairs of a warp binding yarn and an upper side warp, the upper side warp functions as a warp to be woven with an upper side weft to constitute an upper side complete design on the upper side surface, while on the lower side, the warp binding yarn and lower side warp cooperatively form the lower side surface design similar to that formed by another lower side warp.

In the pair 2 of the warp binding yarn and an upper side warp, as shown in FIG. 25B, the warp binding yarn $\mathbf{2}_B$ passes between the upper side layer and lower side layer at upper side wefts 1' to 7', passes under lower side weft 8', passes between the upper side layer and lower side layer at the upper side weft 9', passes over the upper side weft 10', passes between the upper side layer and lower side layer at the upper side wefts 11' and 12', passes over the upper side weft 13', passes between the upper side layer and lower side layer at the upper side wefts 14' and 15' and passes under the lower side weft 16', while the upper side warp $\mathbf{2}_U$ passes between the upper side layer and lower side layer at the upper side weft 1', passes over upper side weft 2', passes between the upper side layer and lower side layer at the upper side wefts 3' and 4', passes over the upper side weft 5' and passes between the upper side layer and lower side layer at the upper side wefts 6' to 16'. Thus, the pair 2 of the upper side warp and warp binding yarn cooperatively form, on the upper side surface, the upper side surface design similar to that formed by another upper side warp.

In this Example, pairs 2 and 6 of a warp binding yarn and an upper side warp and pairs 1, 3 to 5, 7 and 8 of upper side warps and lower side warps are arranged at a ratio of 1:3. Upper side wefts and lower side wefts are arranged at a ratio of 2:1. A ¼-½ design employed for upper side warps improves the rigidity of a wire, while a ⅗ design employed for upper side wefts contributes to the formation of a fabric excellent in a fiber supporting property. In addition, employment of broken twill weave prevents generation of diagonal lines and therefore, prevents generation of marks in the diagonal direction and meandering of a wire. Similar to Example 7, the fabric obtained in this Example does not have a pair of warp binding yarns but has two pairs of a warp binding yarn and an upper side warp. Such a fabric of this Example having pairs of a warp binding yarn and an upper side warp is not inferior in binding power.

Example 9

Figure 27:
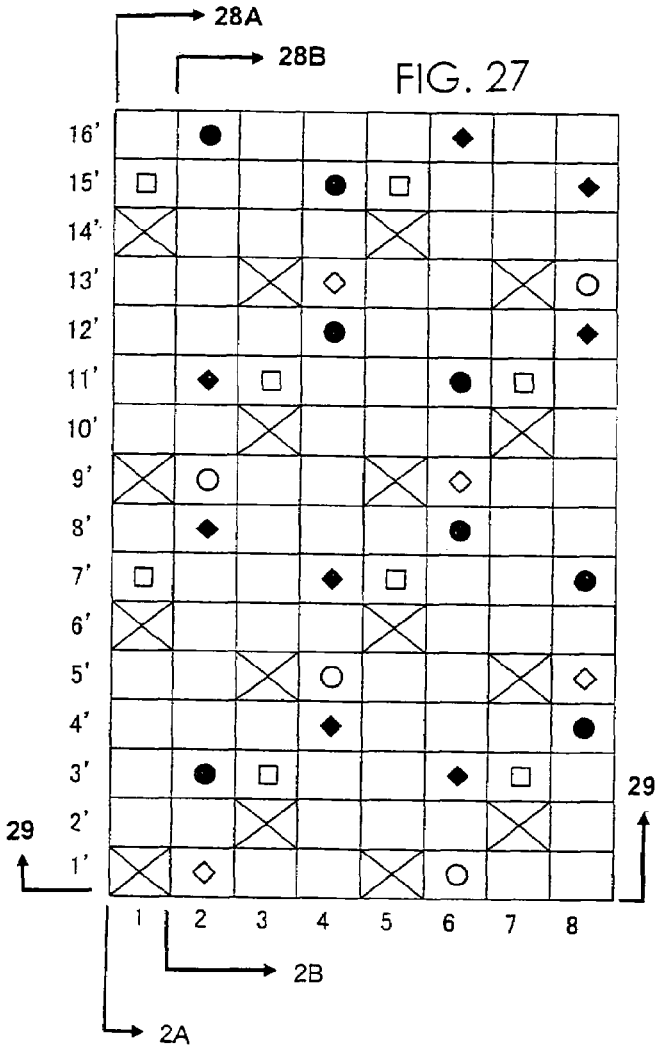
FIG. 27 is a design diagram illustrating a repeating unit of the complete design of Example 9 of the present invention.
Figure 28A:
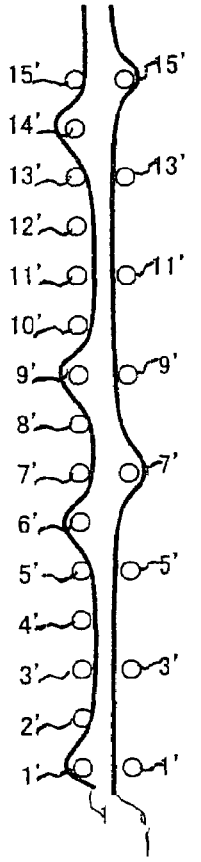
FIGS. 28A and 28B are cross-sectional views taken along the lines 28A-28A and 28B-28B at warps 1 and 2 of FIG. 27 respectively.
Figure 28B:
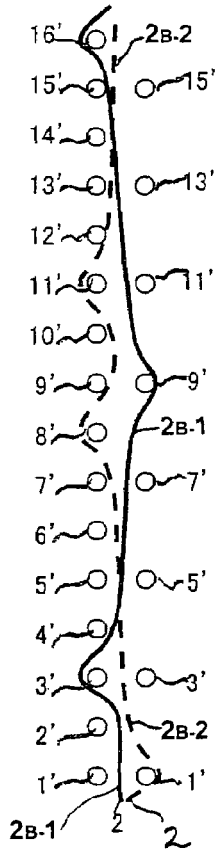
Figure 29:
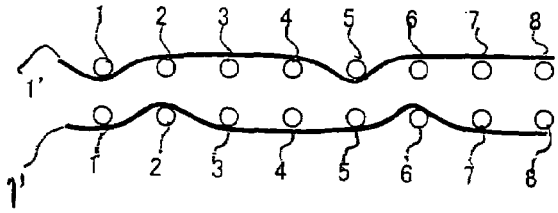
FIG. 29 is a cross-sectional view taken along the line 29-29 at weft 1' of FIG. 27.

FIG. 27 is a design diagram illustrating a repeating unit of the complete design of Example 9 of the present invention. FIGS. 28A and 28B are cross-sectional views taken along the lines 28A-28A and 28B-28B at warps 1 and 2 of FIG. 27 respectively, while FIG. 29 is a cross-sectional view taken along the line 29-29 at weft 1' of FIG. 27.

In the pair 2 of the warp binding yarns, as shown in FIG. 28B, the first warp binding yarn $\mathbf{2}_{B\text{-}1}$ shown in a solid line passes between the upper side layer and lower side layer at the upper side wefts 1' and 2, passes over the upper side weft 3', passes between the upper side layer and lower side layer at the upper side wefts 4' to 8', passes under the lower side weft 9', passes between the upper side layer and lower side layer at the upper side wefts 10' to 15' and passes over the upper side weft 16', while the other second warp binding yarn $\mathbf{2}_{B\text{-}2}$ shown in a broke line passes under the lower side weft 1', passes between the upper side layer and lower side layer at the upper side wefts 2' to 7', passes over the upper side weft 8', passes between the upper side layer and lower side layer at the upper and lower side wefts 9' and 10', passes over the upper side weft 11' and passes between the upper side layer and lower side layer at the upper and lower side wefts 12' to 16'. Thus, the pair 2 of the warp binding yarns cooperatively form, on the upper side surface, the upper side surface design similar to that formed by another upper side warp.

In the design diagram of FIG. 27, of the eight pairs of upper side warps and lower side warps stacked vertically, pairs indicated by 1, 3, 5 and 7 are those of upper side warps and lower side warps, and pairs indicated by 2, 4, 6 and 8 are those of warp binding yarns. Pairs 2, 4, 6 and 8 of warp binding yarns and pairs 1, 3, 5 and 7 of upper side warps and lower side warps are arranged at a ratio of 1:1. Upper side wefts and lower side wefts are arranged at a ratio of 2:1.

Different from broken twill weave of Examples 1 to 8, twill weave is employed in this Example. In the example of Patent Document 1, a ⅓ design in which an upper side warp passes under three successive upper side wefts and then passes over an upper side weft is employed for the upper side layer. By shifting the design so that an upper side weft passes over three successive upper side warps to form a weft long crimp corresponding to three warps on the upper side surface, the resulting fabric has an improved fiber supporting property. In the Example of the present invention, on the other hand, a ¼-½ design is employed as the upper side surface design, whereby more improved wire rigidity than that of the example in Patent Document 1 can be attained. In addition, the surface property and fiber supporting property of the resulting fabric are not inferior to the conventional one because the design is shifted as needed so as to form a long crimp corresponding to three warps on the upper side surface.

The fabric according to the present invention is excellent in rigidity and surface property and also in wear resistance and running stability so that it is suited for use as an industrial fabric in the fields such as papermaking.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2005-146809 filed May 19, 2005 including specification, drawings and claims is incorporated herein by reference in its entirety.

What is claimed is:

1. An industrial two-layer fabric which comprises, in a repeating unit, eight pairs of warps obtained by vertically stacking eight upper side warps and eight lower side warps, a plurality of upper side wefts and lower side wefts, wherein at least one of the eight upper side warps and eight lower side warps being a warp binding yarn for binding an upper side layer and a lower side layer, wherein:

in the upper side layer of the fabric, a first upper side warp disposed above a first lower side warp has a repetition of a design in which the first upper side warp passes over an upper side weft, passes under four successive upper side wefts, passes over an upper side weft, and passes under two upper side wefts, and a first upper side weft has a repetition of a design in which the first upper side weft passes over three upper side warps and then passes under one upper side warp to form a weft long crimp corresponding to three warps on the upper side.

2. An industrial two-layer fabric according to claim 1, wherein a second upper side warp and a second lower side warp of at least one of the eight pairs of the upper side warps and the lower side warps stacked vertically are both warp binding yarns which are woven with the upper side wefts and the lower side wefts to constitute a portion of an upper side surface design and a portion of a lower side surface design; and the warp binding yarns forming a pair are woven with respective upper side wefts and cooperatively function as one warp to constitute an upper side complete design on an upper side surface, while the warp binding yarns forming a pair function as one warp to constitute a lower side surface design also on the lower side surface.

3. An industrial two-layer fabric according to claim 1, wherein a second upper side warp of at least one of the eight pairs of the upper side warps and the lower side warps stacked vertically is a warp binding yarn which is woven with the upper side wefts and the lower side wefts to constitute a portion of an upper side surface design and a portion of a lower side surface design; and wherein, in the pair of the warp binding yarn and a second lower side warp, the warp binding yarn is woven with the upper side weft to function as one warp constituting an upper side complete design on an upper side surface, while on the lower side surface, the warp binding yarn and the second lower side warp cooperatively function as one warp constituting a lower side surface design.

4. An industrial two-layer fabric according to claim 1, wherein a second lower side warp of at least one of the eight pairs of the upper side warps and the lower side warps stacked vertically is a warp binding yarn which is woven with the upper side wefts and the lower side wefts to constitute a portion of an upper side surface design and a portion of a lower side surface design; and, in the pair of a warp binding yarn and a second upper side warp, the warp binding yarn and the second upper side warp are woven with respective upper side wefts and cooperatively function as one warp constituting an upper side complete design on an upper side surface, while the warp binding yarn functions as one warp constituting a lower side surface design op the lower side surface.

5. An industrial two-layer fabric, wherein one of the warp binding yarns forming a pair as claimed in claim 2 is woven with at least one upper side weft to form an upper side surface design, under which the other warp binding yarn is woven with a lower side weft, while the one of warp binding yarns is woven with a lower side weft, over which the other warp binding yarn is woven with at least one upper side weft to constitute the upper side surface design, whereby the warp binding yarns forming a pair complement each other to form the upper side surface design and lower side surface design.

6. An industrial two-layer fabric according to claim 1, wherein the upper side surface design is a broken twill weave.

7. An industrial two-layer fabric according to claim 1, wherein the upper side surface design is a twill weave.

8. An industrial two-layer fabric according to claim 1, wherein a number of the upper side wefts is 1 to 2 times as many as a number of the lower side wefts.

9. An industrial two-layer fabric according to claim 1, wherein the upper side warps and the lower side warps are equal in diameter.

* * * * *